United States Patent [19]

Jursich et al.

[11] Patent Number: 4,810,854

[45] Date of Patent: Mar. 7, 1989

[54] COMPACT PORTABLE VAPORIZER

[75] Inventors: Donald N. Jursich, Chicago; William J. DiGirolamo, Prospect Heights, both of Ill.

[73] Assignee: Sunbeam Corporation, Downers Grove, Ill.

[21] Appl. No.: 54,455

[22] Filed: May 26, 1987

[51] Int. Cl.[4] ..... F22B 1/28

[52] U.S. Cl. ..... 219/276; 219/271; 219/273; 219/275

[58] Field of Search ..... 219/271, 272, 273, 274, 219/275, 276, 362; 422/125, 305, 306

[56] References Cited

U.S. PATENT DOCUMENTS

| | | | |
|---|---|---|---|
| 1,756,053 | 4/1930 | Colton | 219/272 |
| 1,982,904 | 12/1934 | Davis | 219/273 |
| 2,136,085 | 11/1938 | Roe | 219/273 |
| 2,140,516 | 12/1938 | Cowan | 219/274 |
| 2,369,623 | 2/1945 | Utley et al. | 219/273 |
| 2,379,034 | 6/1945 | Pargman | 219/273 |
| 2,443,417 | 6/1948 | Duncan | 219/276 |
| 2,804,870 | 9/1957 | Chelini | 126/113 |
| 2,810,167 | 10/1957 | Parks, Sr. | 422/117 |
| 2,900,895 | 8/1959 | Schwaneke | 219/276 |
| 3,152,240 | 10/1964 | Scott | 219/271 |
| 3,511,236 | 5/1970 | Conlin | 219/276 |
| 3,581,529 | 6/1971 | Mitchell | 219/271 |
| 3,723,707 | 3/1973 | Wunderlin | 219/276 |
| 4,028,444 | 6/1977 | Brown | 219/275 |
| 4,399,349 | 8/1983 | Deming | 219/276 |
| 4,604,246 | 8/1986 | Choe | 261/71 |
| 4,640,804 | 2/1987 | Mizoguchi | 261/81 |

FOREIGN PATENT DOCUMENTS

| | | | |
|---|---|---|---|
| 54-108453 | 8/1979 | Japan | 219/271 |
| 1010416 | 11/1965 | United Kingdom | 219/273 |

*Primary Examiner*—Teresa J. Walberg

*Attorney, Agent, or Firm*—Mason, Kolehmainen, Rathburn & Wyss

[57] ABSTRACT

A steam vaporizer for domestic use having a base for supporting a removable reservoir and steam chamber including a steam directing conduit with selectively positionable nozzle, said conduit and nozzle having double walled construction to maintain exposed parts at a low temperature. Air circulation is provided from the base into the steam chamber across the boiler to circulate the steam out through the nozzle. A cup-shaped boiler forming a portion of said steam chamber with said conduit and nozzle being removable from said base to expose the boiler for cleaning purposes. The boiler is provided with a drain to permit intermittent flushing of accumulated residue.

23 Claims, 5 Drawing Sheets

COMPACT PORTABLE VAPORIZER

BACKGROUND OF THE INVENTION

The invention relates generally to humidification apparatus and more specifically to portable steam vaporizers intended for domestic use.

There are a number of different types of products used to increase the humidity in the home environment. Particularly during the winter season, the low humidity prevailing in most homes has led to the widespread use of some type of humidification means. Although in connection with forced air central heating there are often provided central humidification means in connection with the heating system, the more limited capacity portable humidifying appliances are in more widespread use. With respect to the portable humidifying appliances, they may be broken down broadly into two categories, one being the evaporation type and the other being the steam vaporizer type. The evaporation type humidifiers usually have had the larger water capacity and utilize belts, pumps, slingers or the like to increase the rate of evaporation of the water from the liquid to the vapor state. In general, the steam vaporizers have been of a more limited capacity and have been used often to achieve very high humidification levels as in the rooms of people with respiratory ailments and the like.

There are also humidifiers which use ultrasonic means to atomize water and thereby increase humidity. An example of such humidifiers is shown in Mizoguchi U.S. Pat. No. 4,640,804.

Examples of various prior art steam vaporizers are shown in the patents to Utley et al Pat. No. 2,369,623; Chelini Pat. No. 2,804,870; Parks, Sr. Pat. No. 2,810,167; Scott Pat. No. 3,152,240; Wunderlin Pat. No. 3,723,707; and Choe Pat. No. 4,604,246. All of these patents are characterized by disclosing steam type humidification means in which there is a reservoir or water supply of some type which supplies water in controlled amounts to a boiler or heating means which is intended to convert the water into a steam vapor. Of these prior art patents, the Chelini patent is an example of a non-portable type humidifier which is associated with a central heating system. It is, however, similar to the portable devices in that it has a water supply means which is connected by a conduit to a boiler in which a limited quantity of water is heated by electrical means to convert the water to steam.

There are many problems involved with the prior art steam vaporizers, primarily related to the rapid deterioration resulting from the problems with the heating elements and the impurities normally associated with boiling water. The mineral deposits which are left as the water boils away in the steam generating area tend to deteriorate the heating element or reduce its effectiveness and ultimately render the device inoperable.

Another problem often associated with prior art humidifiers is the danger to the user resulting from the high temperature of the steam used for humidification and the tendency for the steam to heat up the parts of the vaporizer whereby the user may be burned either by the heated parts on the appliance or the steam itself. Accordingly, it is desirable to provide means to avoid this overheating of the vaporizer parts and also to prevent the user from being exposed to the high temperature steam.

SUMMARY OF THE INVENTION

The instant invention is directed to an improved portable steam vaporizer which utilizes a generally rectangular base to detachably support a reservoir and an insulated steam directing conduit in which a rotatable nozzle is supported. The base supports and encloses an electrically heated cup-shaped boiler which, together with the steam directing conduit, forms a steam chamber, the walls of which are insulated to eliminate any overheated exposed parts which might create a risk of burns to the user. The compact reservoir is nested in superimposed relationship with respect to the base and has a valve which is automatically actuated as the reservoir is positioned on the base and which controls the level of water delivered to the cup-shaped boiler. A fan is provided in the base to circulate air into the base and upwardly through the steam directing conduit to increase the rate of flow of steam from the vaporizer nozzle. A flush conduit is connected to the bottom of the cup-shaped boiler to permit flushing the residue which normally collects in the bottom of the boiler as a consequence of the impurities in the water being converted to steam.

Accordingly, it is an object of the present invention to provide an improved compact portable steam vaporizer.

It is a further object of the present invention to provide a compact steam vaporizer which has a rectangular box-like configuration with the water reservoir and steam directing conduit removably supported on and overlying a rectangular base.

It is another object of the present invention to provide a compact portable steam vaporizer having air circulation means to introduce air into the steam chamber adjacent the boiler to increase the rate of steam flow from the vaporizer.

It is another object of the present invention to provide an improved steam vaporizer having an electrically heated cup-shaped boiler which is supplied with water at a controlled level from a remote reservoir and which includes flush means for eliminating impurities from the cup-shaped boiler by periodically running water through the boiler and out the drain.

Further objects and advantages of the instant invention will become obvious to one skilled in the art as the following description proceeds, and the features of novelty which characterize the invention will be pointed out in the claims annexed to and forming a part of the specification.

BRIEF DESCRIPTION OF THE INVENTION

Figure 1:
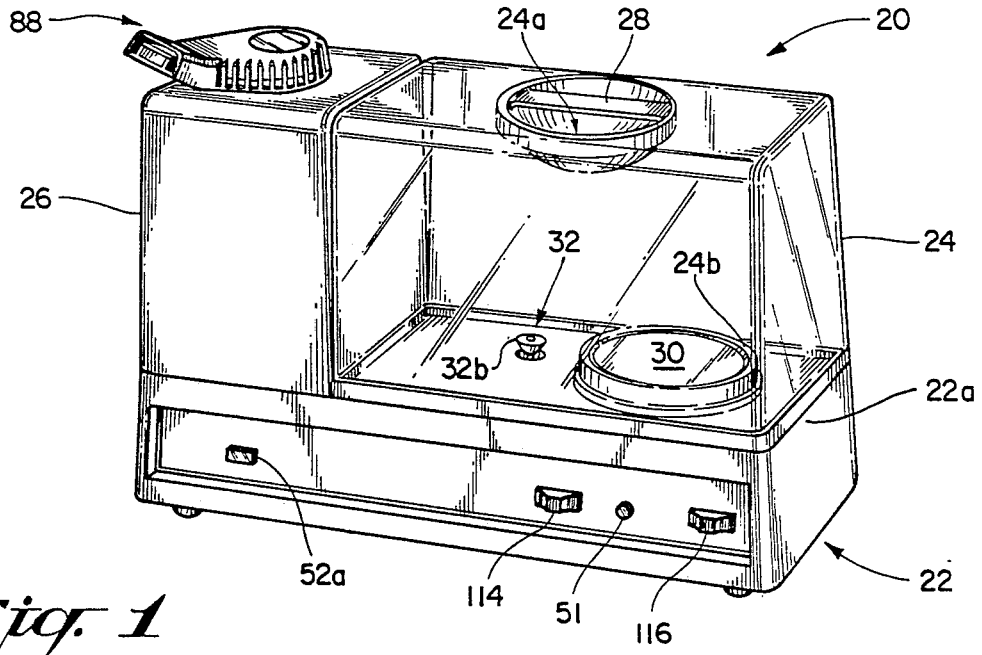
FIG. 1 is a perspective view of a steam vaporizer embodying our invention.

Referring to the drawings, there is shown in FIG. 1 a steam vaporizer embodying my invention and designated generally by reference numeral 20. The steam vaporizer 20 includes three major elements, a base 22, a water reservoir 24 and a steam directing conduit 26. The water reservoir 24 merely rests on the base 22 which has a peripheral ledge 22*a* within which the lower portion of the water reservoir 24 is received. As may best be seen in FIGS. 1 and 2, the reservoir 24 is of a rectangular box-like configuration having a handle 28 in its upper wall, there being an integrally formed pocket 24*a* within which the handle is received. The handle 28 is secured to the reservoir 24 by screws 29, as shown in FIG. 2, the pocket 24*a* providing clearance so that the handle may be gripped by the hand.

In the wall of the reservoir 24 opposite the handle 28 there is a filling opening 24*b* which is closed by a cap 30 shown only in FIG. 1. The cap 30 is threadedly received in the opening 24*b* and is removable to permit filling of the reservoir 24 when the reservoir is removed from the base 22 and inverted so that the handle 28 is downward.

Figure 2:
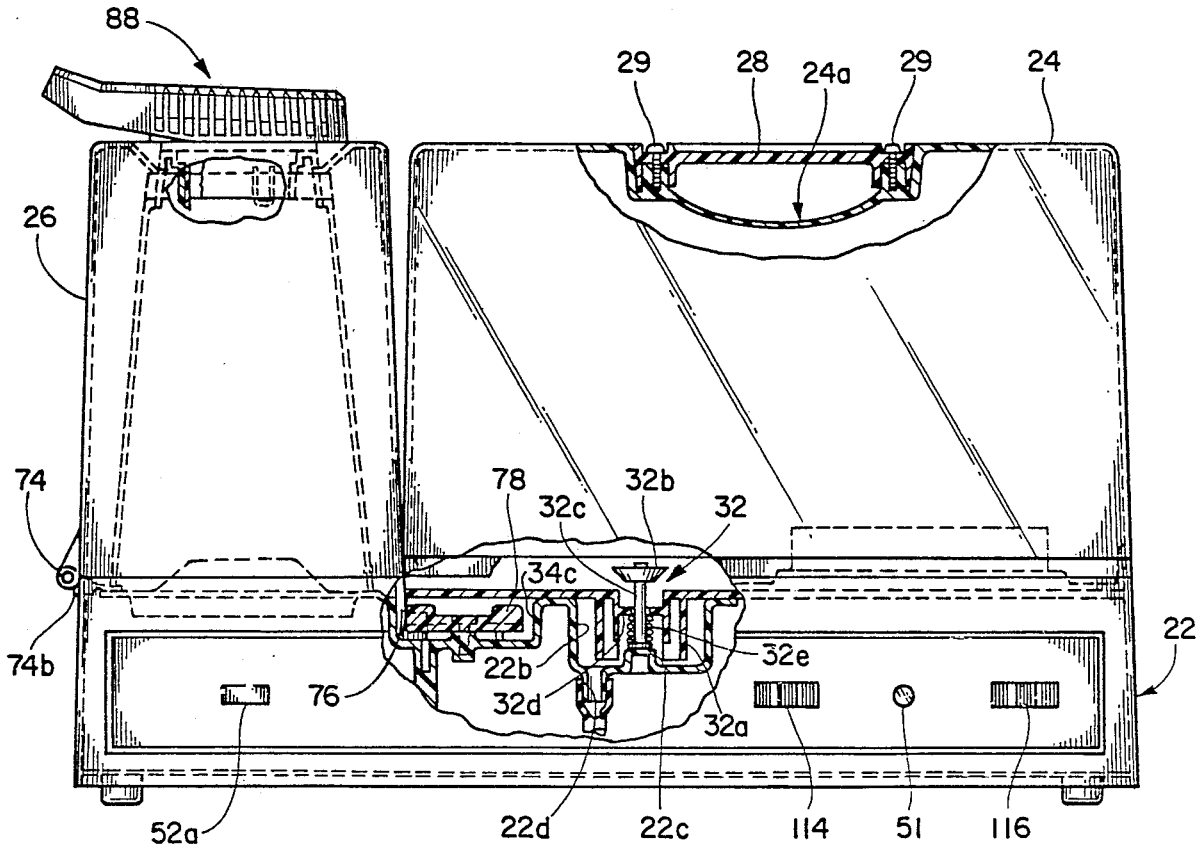
FIG. 2 is a front elevational view of the vaporizer of FIG. 1 with sections cut away to show the reservoir handle and the valve means for the reservoir and the latch member to retain the steam directing conduit in place.
Figure 3:
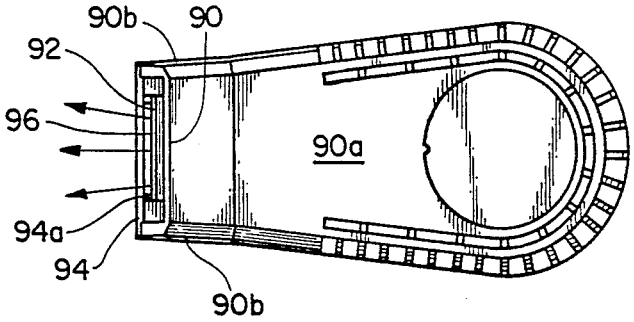
FIG. 3 is a top plan view of the steam directing nozzle.
Figure 5:
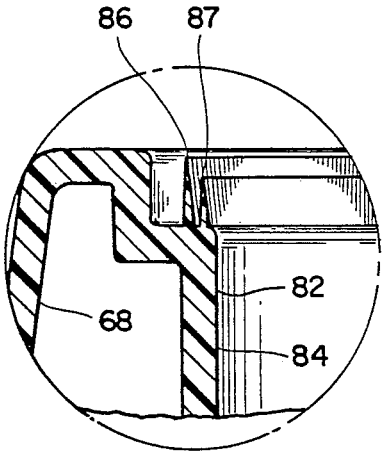
FIG. 5 is an enlarged view of a portion of the cutaway view from FIG. 4 which was shown circled in dash lines in FIG. 4.

As best shown in FIG. 2, the reservoir 24 is provided with a valve 32 which includes a cylindrical portion 32*a*, a closure member 32*b* supported by a valve stem 32*c* slidably supported by a guide 32*d*. The valve stem 32*c* and the closure member 32*b* are biased downwardly by spring 32*e* as shown in FIG. 2. When the reservoir 24 is in position on the base 22, the valve 32 with its cylindrical portion 32*a* extends into a pocket 22*b* in base 22 in which there is located a projection 22*c* and a water outlet 22*d*. With the valve positioned in the pocket 22*b*, the valve stem 32*c* engages the projection 22*c* urging it upwardly to the open position as shown in FIG. 2. When the reservoir 24 is removed from the base 22, the closure 32*b* is biased to a closed position so that no water may exit through the valve 32. Thus, when the reservoir 24 is initially filled, it is in the inverted position as compared to the one shown in FIGS. 1 and 2 with the handle 28 positioned downwardly and the opening 24*b* facing upwardly. With the cap 30 removed, the reservoir 24 may be filled in the sink and then, after the cap has been replaced, it may be inverted and, with the valve 32 closed, it may be transported to the base 22 where it is placed in position with the lower portion inside of the lip 22*a* and the valve 32 extending into the pocket 22*b* at which time the projection 22*c* opens the valve 32 allowing water to pass into the pocket 22*b*.

Figure 6:
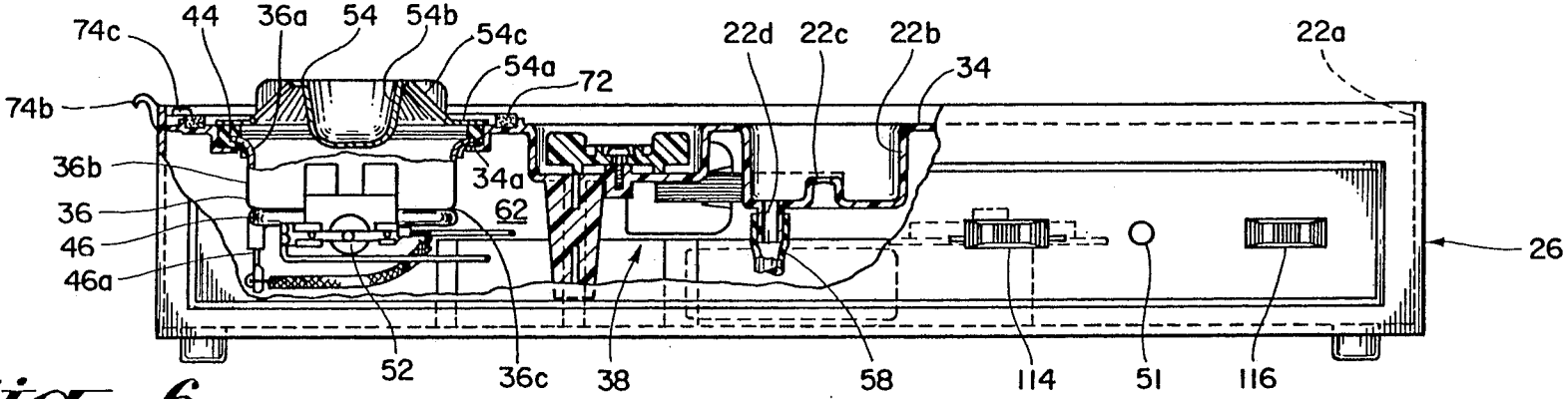
FIG. 6 is a front elevational view of the base with portions cut away to expose the steam generating boiler cup, the latch for the steam directing conduit and the socket into which the valve for the water reservoir extends.
Figure 7:
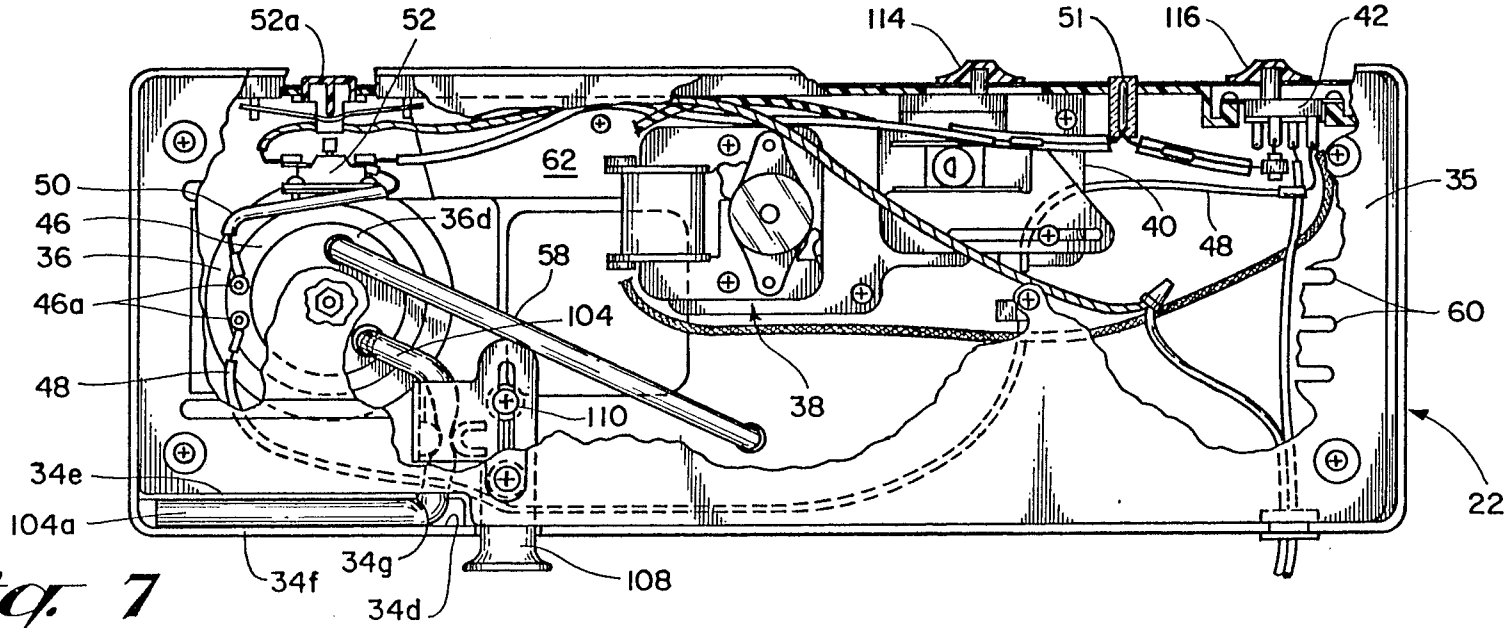
FIG. 7 is a bottom plan view of the vaporizer base with portions of the bottom plate cut away to expose the controls, the humidistat, the fan motor and the bottom of the boiler cup.

The base 22 is formed by a molded plastic member 34 which, together with a bottom plate 35, forms a housing within which various parts, including a boiler cup 36, a motor driven fan 38, a humidistat 40 and a switch 42 are mounted. These various parts are best shown in FIGS. 6 and 7 which also show the bottom plate 35 with portions thereof cut away.

The steam boiler cup 36 is a shallow, stainless steel cup which has a peripheral lip 36*a* received in a sealing gasket 44 which rests in a shouldered opening 34*a* in the molded base member 34. The cup 36 includes cylindrical side walls 36*b* and an annular stepped portion 36*c* which is of sufficient height from a flat bottom 36*d* to accommodate a sheathed heating element 46, the lower edge of the sheathed element being flush with the bottom 36*d*. The sheathed heating element 46 is brazed to the stepped portion 36*c* of the cup 36 and has terminals 46*a* which are connected by wires 48 and 50 in series with the switch 42 and a thermostat or thermostatic switch 52. The thermostat 52 is clamped against the side wall of the cup 36 to prevent overheating of the boiler cup 36 in the event the cup boils dry. There is a reset button 52*a* which must be pushed to reset the thermostat 52 in the event it opens in an overheat situation.

Figure 14:
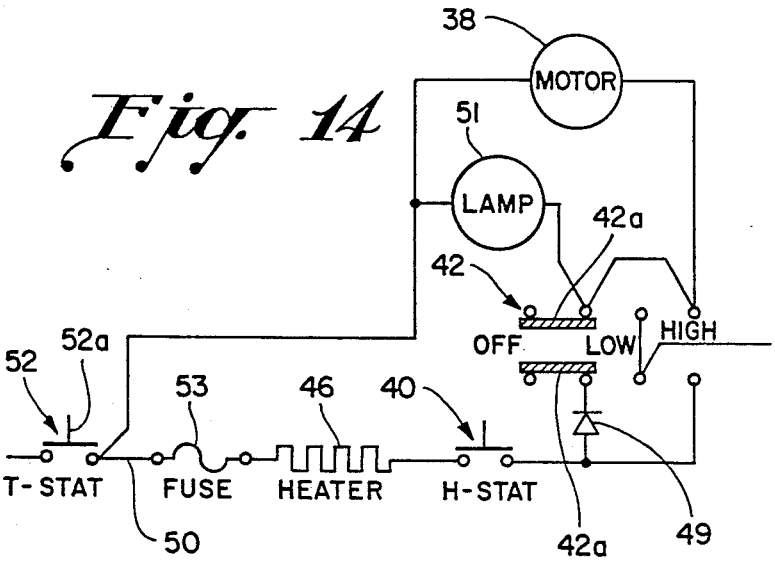
FIG. 14 is a schematic diagram showing the electrical circuit for our steam vaporizer.

A schematic circuit diagram of the steam vaporizer 20 is shown in FIG. 14. The switch 42 is shown in FIG. 14 in its "off" position which is the left position while the "low" position is in the center and the "high" position is farthest to the right. The switch 42 includes two conductive bridging members 42*a*, each of which electrically connects two different adjacent contacts, depending on the switch setting. In the "low" setting, the heating element 46 is connected across the power supply in series with a diode 49 which reduces by half the power to the heating element 46. In the "high" switch position, the full power is connected to the heating element 46. In both the "low" and "high" switch positions, the motor fan 38 and a signal lamp 51 are connected in parallel with the heating element 46 and across the line. As is also shown in FIG. 14, the humidistat 40 and a fuse 53 are connected in series with the heating element 46.

Figure 9:
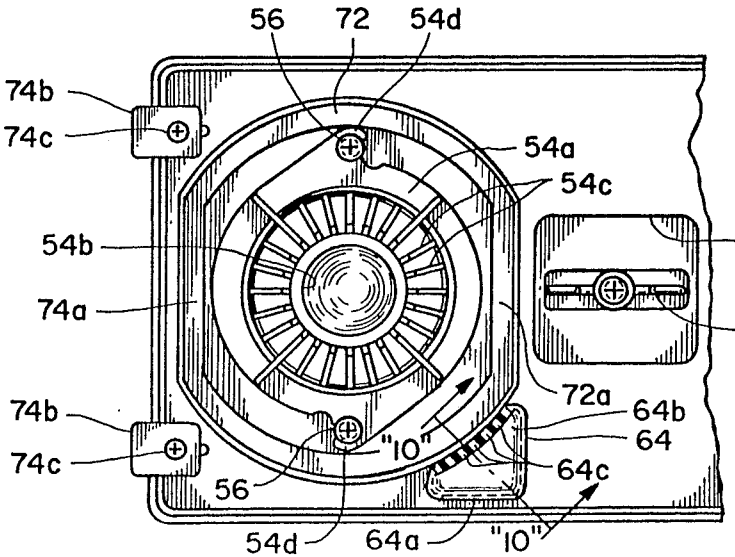
FIG. 9 is a fragmentary top plan view of one end of the base with the steam directing conduit and the water reservoir removed.
Figure 11:
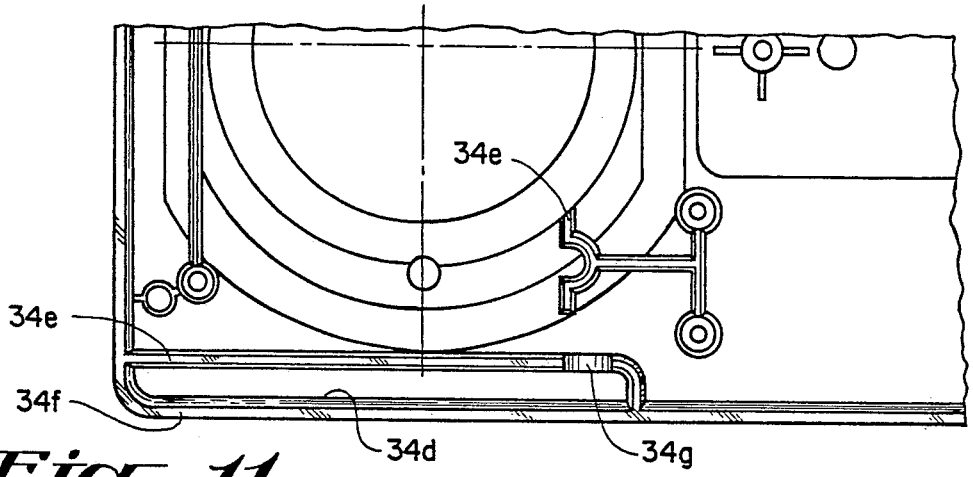
FIG. 11 is a fragmentary bottom plan view of a portion of the molded base member with the various parts removed from it.

Positioned immediately above the boiler cup 36 is a medicament cup 54 which includes an annular outer portion 54*a*, a well portion 54*b* and interconnecting web members 54*c*. A pair of shoulder screws 56 threadedly engaged with the molded base member 34 engage hook portions 54*d* on the outer annular portion 54*a* to retain the medicament cup in position, overlying the gasket 44. There is sufficient clearance beneath the heads of screws 56 that the medicament cup 54 may be rotated counterclockwise, as shown in FIG. 9, to disengage the hook portions 54*d* from the screws 56, permitting removal of the medicament cup 54 to allow access to the boiler cup 36.

To deliver water from the pocket 22*b* to the boiler cup 36, there is provided a conduit 58 as is best shown in FIG. 7. The conduit 58 is a silicon rubber tube which fits tightly over the outlet 22*d*, as shown in FIG. 6, and engages a corresponding nipple on the bottom wall of cup 36. With the conduit 58 connecting the pocket 22*b* and the boiler cup 36, the water level within the cup 36 is determined by the water level within the pocket 22 which, in turn, is determined by the downward extent of the cylindrical portion 32*a* of the valve 32. Water will flow through the valve 32 until the level within the pocket 22*b* is of sufficient depth to prevent any air from flowing into the reservoir 24 and eliminating the vacuum which otherwise causes the water to remain in the reservoir. As long as air may bubble upwardly through the water in the reservoir 24, water will continue to flow out through the valve 32. Once the water in the pocket 22*b* is sufficiently deep to block off the end of the cylindrical portion 32*a*, flow from the reservoir will cease, as will the flow through the conduit 58 into the boiler cup 36. Thus, the heating element 46 will cause the water to boil in the bottom of the cup 36, causing steam to pass upwardly through the web member 54*c* of the medicament cup 54. As the level of the water decreases in the cup 36 it is replenished by further flow through the conduit 58, assuring a continuous supply of water to the steam generating chamber until the water in the reservoir 24 has been exhausted.

Figure 8:
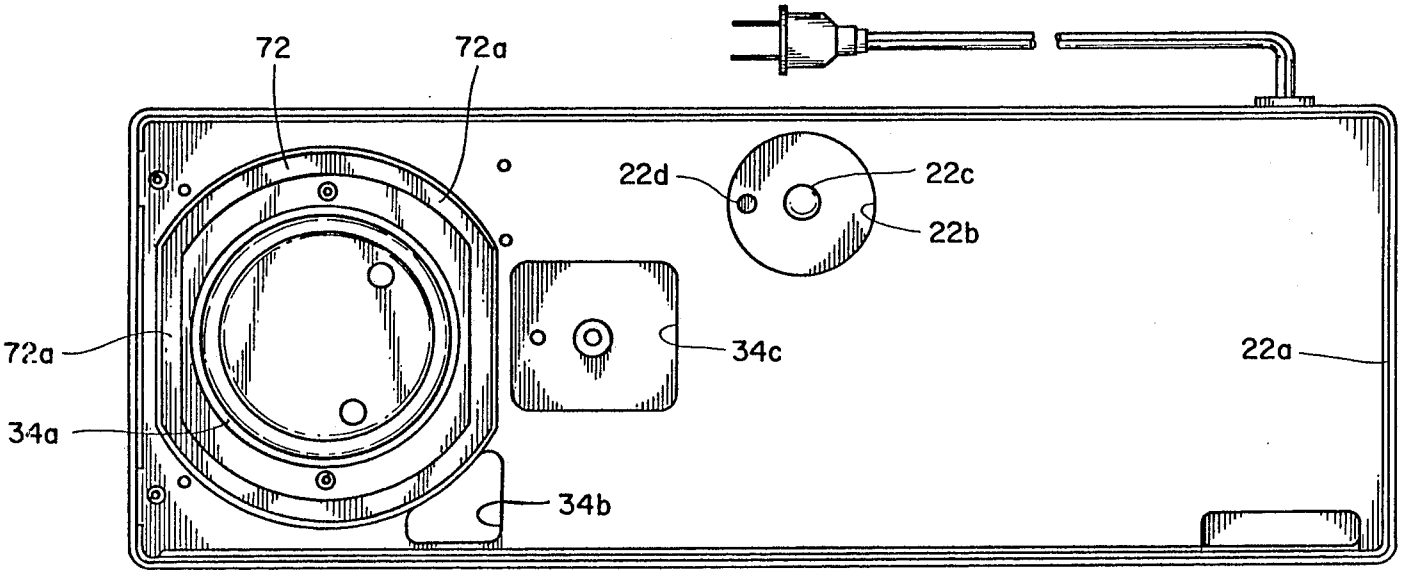
FIG. 8 is a top plan view of the base with the reservoir and steam directing conduit removed.
Figure 10:
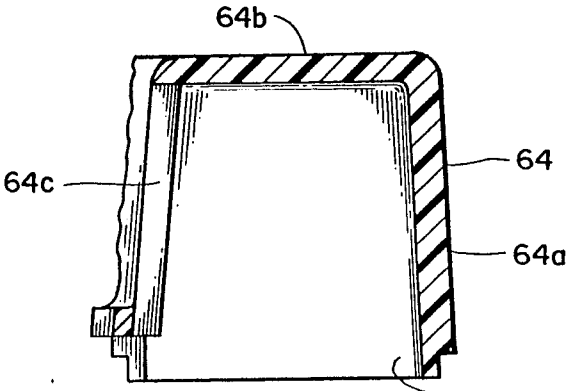
FIG. 10 is an enlarged sectional view of the director taken on line 10—10 of FIG. 9.

In order to increase the flow of steam from the area of the boiler cup 36 and to reduce the heating effects of the steam on the exposed parts of the steam vaporizer 20, there is provided the motor fan 38 which draws air inwardly through openings 60 in the bottom plate 35 circulating air through duct means 62, as shown in FIGS. 6 and 7, and upwardly through a somewhat triangular opening 34*b* formed in the molded plastic base member 34, as best shown in FIG. 8. The air circulated upwardly through the opening 34*b* is then redirected inwardly toward the boiler cup 36 by an air director 64 which is best shown in FIGS. 9 and 10. The director 64 has two vertical walls 64*a* and a top wall 64*b* which form a hood to direct the upwardly blowing air horizontally through the louvered opening 64*c*. The air enters the director through the bottom opening 64*d*.

Figure 4:
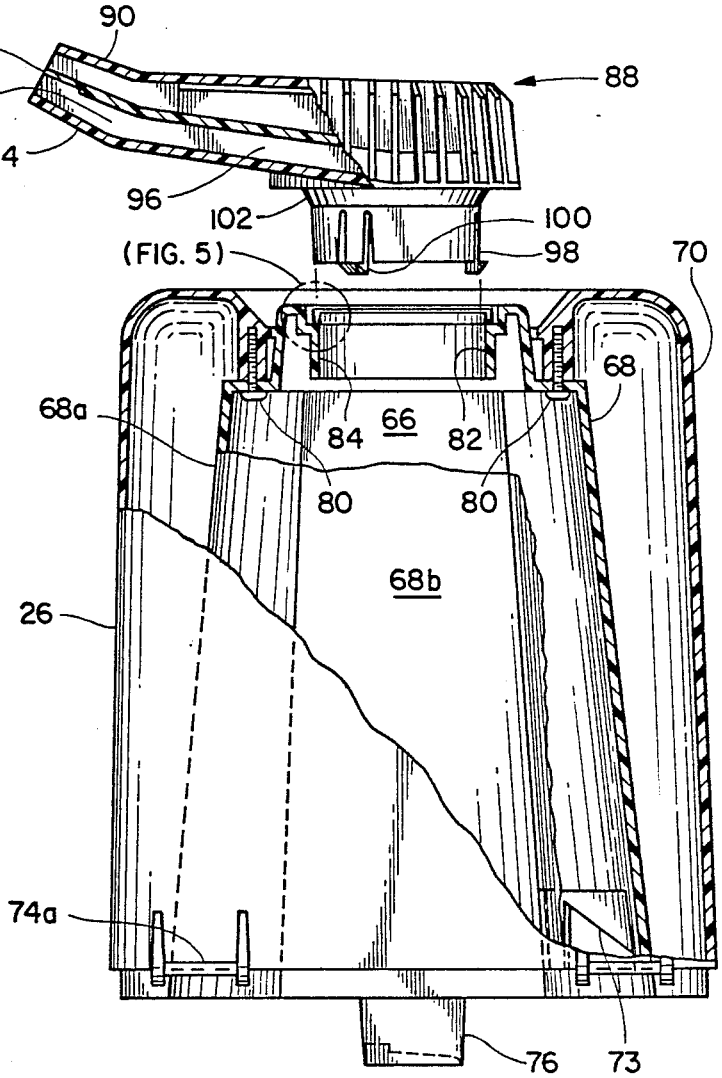
FIG. 4 is a side elevational view of the steam directing conduit with its nozzle shown in the disassembled position and portions of the conduit and the nozzle cut away for illustrative purposes.

Detachably mounted on the base 22 above the boiler cup 36 is the steam directing conduit 26 which is best shown in FIGS. 2 and 4. The steam directing conduit 26, along with the boiler cup 36, forms steam generating chamber 66. The steam directing conduit 26 has an inner wall 68 and an outer wall 70, as are best shown in FIG. 4. The inner wall has a generally cylindrical configuration 68*a* interrupted by opposed flat portions which comprise generally vertical opposite side walls 68*b*. The inner wall 68 engages at the bottom edge a gasket 72 as shown in FIGS. 8 and 9. The generally circular shape of the gasket 72 with parallel straight sides 72*a* illustrates the shape of the bottom edge of the inner wall 68 which tapers inwardly as it extends upwardly, as shown in FIG. 4. The outer wall 70 is substantially square in its horizontal section with the lower edge resting inside of the lip 22*a* of the base 22, as is best illustrated in FIGS. 1 and 2.

The air circulated by the motor fan 38 is discharged horizontally from the director 64 which is located in one corner of the steam directing conduit 26 between the inner wall 68 and the outer wall 70. To allow the air from the director 64 to flow inwardly across the boiler cup 36, the inner wall 68 is formed with an opening 73 as shown in FIG. 4.

The base 22 and the outer wall 70 of the steam directing conduit 26 are provided with means forming two spaced hinges 74 which pivotally interconnect the steam directing conduit 26 to the base 22 for rotation about a generally horizontal axis running along the left edge of the base 22.

The lower edge of the outer wall 70 on the side opposite from the hinge location is provided with an inverted L-shaped latch member 76 which extends into a rectangular recess 34*c* where it is engaged by a rotatable locking member 78 to detachable retain the steam directing conduit in assembled relation with respect to the base 22. When it is desired to place some material in the medicament cup 54, the reservoir 24 may be removed from the base 22, the lock member 78 rotated 90 degrees from the position shown in FIG. 9 to allow the latch portion 76 to be disengaged from the lock member 78 and allow the steam directing conduit 26 to be rotated to a generally horizontally extending position, thereby exposing the medicament cup 54. Each hinge 74 includes a hinge pin 74*a* integrally formed with the outer wall 70 which cooperates with a hook-shaped portion 74*b* secured to the molded base member 34 by a screw 74*c* to complete the hinge.

As shown in FIG. 4, the inner wall 68 and outer wall 70 of the steam directing conduit 26 are secured together by screws 80 which are located radially outwardly from a top opening 82 formed in the inner wall 68. Associated with the opening 82 is a cylindrical flange 84 and a pair of integrally formed cylindrical sealing gaskets 86, 87.

Received within the opening 82 is the nozzle 88 which has an outer wall 90 and an inner wall 92 which provide a double wall construction on the top and sides of the nozzle 88. The outer wall 90 includes a top wall 90*a* and side walls 90*b* which form a downwardly facing channel which is closed by a bottom wall 94. The bottom wall 94 is formed with intermediate partitions 94*a* at the upper edges of which the inner wall 92 is supported to form nozzle passageway 96. The outer wall 90 is formed with a downwardly extending cylindrical portion 98 which is received within the cylindrical portion 84 associated with the opening 82. Integrally molded latches 100 located at diametrically opposite sides of the cylindrical portion 98 snap into engagement with the lower edge of the cylindrical flange 84 to lock the nozzle 88 assembled to the steam directing conduit 26. As thus assembled, the nozzle is journaled for rotation about a vertical axis so as to direct the passageway 96 in any desired horizontal direction. Thus, the steam passes upwardly from the boiler cup 36 through the web portions 54*c* of the medicament cup upwardly through the steam directing conduit 26, through the opening 82 into the nozzle 88 and then laterally through the passageway 96 where the terminal portion directs the issuing steam outwardly and upwardly at a slight angle. The double wall construction involving the outer wall 90 and the inner walls 92 and 94*a* provide a nozzle which is sufficiently insulated so that the exposed parts do not reach a temperature high enough to burn the user in spite of the fact that the steam is passing through the passageway 96.

When the nozzle 88 is in its assembled condition with respect to the steam directing conduit 26, the two sealing gaskets 86,87 engage and are slightly deflected by an angled wall 102 which extends upwardly from the top of the cylindrical portion 98, thereby forming a well sealed joint which prevents any steam from leaking through the pivotal connection between the nozzle 88 and the steam directing conduit 26.

Figure 12:
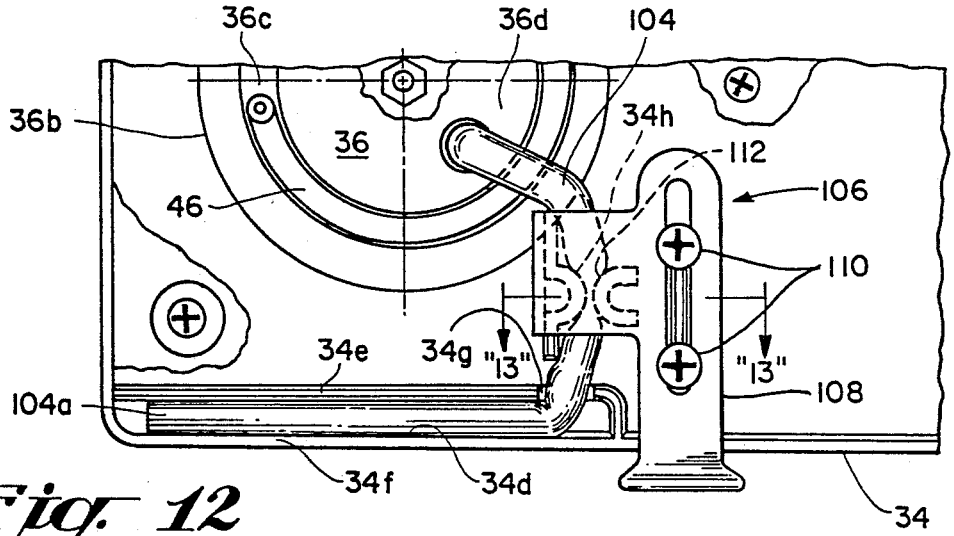
FIG. 12 is a fragmentary bottom plan view similar to FIG. 11 but with the boiler cup, flush tube and flush control shown assembled to the molded base member.

In view of the fact that the water normally used in steam vaporizers often contains substantial amounts of impurities which tend to deposit when the water is boiled away, it is desirable to have means to eliminate the residue which otherwise continues to accumulate until it interferes with heat transfer and other functions of the vaporizer. In order to flush these impurities, the boiler cup 36 is provided with a flush tube 104 which extends downwardly from the bottom of the boiler cup 36, terminating in an extension portion 104*a* which is received within a downwardly facing slot 34*d* formed in the rear wall of the molded base member 34, as is best shown in FIGS. 7 and 12. The slot 34*d* is formed by two spaced walls 34*e* and 34*f* which may be spaced a distance slightly less than the outer diameter of the tube 104 so that as a consequence of a slight interference fit, the tube 104 will be retained in the slot 34*d*. Rubber tubing normally has enough curvature so that the walls of the slot 34*d* may actually be spaced apart more than the diameter of the tube 104 and the engagement between the tube and the walls 34*e* and 34*f* will be adequate to retain the extension 104*a* within the slot. The tube 104 extends from within the base compartment in which the boiler cup 36 is mounted through an opening 34*g* in wall 34*e* into the slot 34*d*. The bottom plate 35 is cut out in the area of the slot 34*d* so that the free end of the extension 104*a* may be manually removed from slot 34*d*, permitting it to drain water into a suitable sink or drain.

Figure 13:
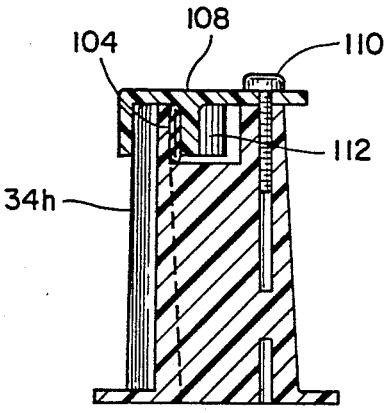
FIG. 13 is a partial sectional view of the flush valve mechanism taken substantially on line 13—13 of FIG. 12.

Intermediate the portion where the tube 104 connects to the cup 36 and the extension 104*a*, there is a pinch valve 106 which comprises a slide member 108 secured to the molded base member 34 by means of screws 110, as best shown in FIGS. 12 and 13. As shown in FIG. 12, the pinch or flush valve 106 is in the closed position in which the slide member 108 grips the tube 104 between an abutment 34*h* and an abutment 112 on the slide member 108. When the slide member 108 is moved downwardly from the position shown in FIG. 12, the abutments 34*h* and 112 become sufficiently spaced to allow the tube 104 to expand and for water to pass through from the cup 36 through the extension 104*a* and to a suitable drain. This permits the user to clean out the impurities in the boiler cup 36 by merely allowing water to run through on the conduit 58 into the cup 36 and thence to the drain through the tube 104. This provides a simple and effective means of flushing the accumulated residue from the boiler cup 36.

The humidistat 40 is mounted within the base 22 in a position to have its sensor impinged by the air moving through the openings 60 to the motor fan 38 and through the air conduit 62 to the steam generating chamber. A front control knob 114 permits the user to select the level of relative humidity to which the control is to operate. The switch 42 has a slide control 116 which permits the operator to select between a "high" and "low" input to the heating element 46 and an "off" position, which positions were described above in connection with the schematic diagram of FIG. 14. In the "low" position, diode 49 is connected in series with the heating element 46 to reduce to one-half the wattage delivered to the heater and thereby reduce the rate of steam generation.

The steam vaporizer of the instant invention is compact and highly efficient. The circulation of air through the base and across the boiler cup in the steam generating chamber provides means for increasing the delivery of steam from the unit. By circulating the steam out of the steam chamber more rapidly, the steam has less effect in increasing the temperature of the parts to which it is exposed and, therefore, maintains all parts of the steam vaporizer at temperature levels that are safer for the user. The double walled nozzle and steam directing conduit eliminate the possibility of injury to the user as a consequence of the steam flowing therethrough. The flush mechanism associated with the simple boiler cup provide a means for maintaining the operating efficiency of the vaporizer through long periods of use and eliminates the need to invert the base 22 to rinse out and pour from the boiler cup 36 accumulated impurities or deposits.

What is claimed as new and desired to be secured by Letters Patent of the United States is:

1. A steam vaporizer comprising a support base, a water reservoir removably received on said base, valve means on said reservoir activated by means on said base, a steam generating chamber including a cup-shaped receptacle in said base having an electric heating element to convert water in said receptacle into steam, water Conduit means extending from said valve means to said receptacle to supply water from said reservoir to said receptacle, said chamber having a removable cover overlying said cup-shaped receptacle, said cover having a nozzle which is movable to direct steam generated in said chamber in selected directions; wherein said cup-shaped receptacle has a bottom wall, a drain conduit connected to an opening in said bottom wall to permit draining of residue from said receptacle having a free end which extends to the exterior of said housing; and wherein said base housing is formed with an elongated open recess into which said drain conduit extends, said recess having parallel walls which are spaced a distance substantially equal to the outside diameter of the drain tube so the engagement between the drain conduit and said parallel walls will retain the end of the drain conduit within the open recess when not in use and permit it to be manually withdrawn to drain residue when desired.

2. A steam vaporizer comprising a support base, a water reservoir removably received on said base, valve means on said reservoir activated by means on said base, a steam generating chamber including a cup-shaped receptacle in said base having an electric heating element to convert water in said receptacle into steam, water conduit means extending from said valve means to said receptacle to supply water from said reservoir to said receptacle, said chamber having a removable cover overlying said cup-shaped receptacle, said cover having a nozzle which is movable to direct steam generated in said chamber in selected directions; wherein said cover comprises an insulated conduit extending vertically from said support base and terminating at its upper end in an opening in which said nozzle is mounted for rotation about a generally vertical axis.

3. A steam vaporizer comprising a support base, a water reservoir removably received on said base, valve means on said reservoir activated by means on said base, a steam generating chamber including a cup-shaped receptacle in said base having an electric heating element to convert water in said receptacle into steam, water conduit means extending from said valve means to said receptacle to supply water from said reservoir to said receptacle, said chamber having a removable cover overlying said cup-shaped receptacle, said cover having a nozzle which is movable to direct steam generated in said chamber in selected directions; including air circulation means mounted within said base, air inlet openings in said base to permit air to be drawn into said base by said air circulation means, an air conduit extending from said air circulation means into said steam generating chamber, air circulated to said steam generating chamber by said air circulation mean being discharged through said nozzle and carrying with it entrained steam.

4. The steam vaporizer of claim 3 wherein said air conduit includes a discharge head adjacent said cup-shaped receptacle to cause said air to pass across said cup-shaped receptacle.

5. A steam vaporizer comprising a support base, a water reservoir removably received on said base, valve means on said reservoir activated by means on said base, a steam generating chamber including a cup-shaped receptacle in said base having an electric heating element to convert water in said receptacle into steam, water conduit means extending from said valve means to said receptacle to supply water from said reservoir to said receptacle, said chamber having a removable cover overlying said cup-shaped receptacle, said cover having a nozzle which is movable to direct steam generated in said chamber in selected directions; wherein said cover is a steam directing conduit having insulating side walls and an opening remote from said cup-shaped receptacle in which said nozzle is supported, said nozzle having a support sleeve which is journaled for rotation in said opening,

6. The steam vaporizer of claim 5 wherein said nozzle and cover are of molded plastic having integrally formed sealing gaskets which are annular cylindrical walls coaxial with the axis of rotation of said nozzle and deformed by the adjacent relatively rotating parts to seal said cover and nozzle.

7. The steam vaporizer of claim 6 wherein said nozzle is journaled for rotation about a generally vertical axis and includes a steam passageway which extends generally horizontally, said nozzle having insulated top and side walls to prevent said steam from heating the outside walls to a temperature dangerous to the user.

8. A steam vaporizer comprising a support base, a water reservoir removably received on said base, valve means on said reservoir actuated by means on said base, a steam generating chamber including a cup-shaped receptacle in said base having an electric heating element to convert water in said receptacle into steam, water conduit means extending from said valve means to said receptacle to supply water from said reservoir to said receptacle, said chamber having a cover overlying said cup-shaped receptacle, said cover comprises an insulated conduit extending vertically from said support base and terminating at its upper end in an opening in which a nozzle is mounted for directing the discharge of steam from said chamber, said cover and said reservoir being in abutting relationship on said base and together being coextensive with said base, said cover having a lower edge in engagement with said base, said cover being hingeably connected to said base along said lower edge whereby said cover is pivotal about said hinge to a position displaced from said cup-shaped receptacle.

9. The steam vaporizer of claim 8 wherein said base includes a top wall supporting said cover and said reservoir, said cup-shaped receptacle being mounted on said top wall, latch means restraining said cover from pivotal movement about said hinge, said latch means being located in a recess in said top wall under said reservoir, a portion of said cover extending into said recess for engagement with said latch.

10. The steam vaporizer of claim 8 including air circulation means mounted within said base, air inlet openings in said base to permit air to be drawn into said base by said air circulation means, an air conduit extending from said air circulation means into said steam generating chamber, air circulated to said steam generating chamber by said air circulation means being discharged through said nozzle and carrying with it entrained steam, said base including a top wall supporting said cover and said reservoir, said air conduit including an opening in said top wall of said base adjacent to said cup-shaped receptacle and positioned under said cover, an air director overlying said air conduit opening and extending upwardly from said top wall to direct said circulated air across said cup-shaped receptacle.

11. The steam vaporizer of claim 8 wherein said cover comprises two nested conduit members secured together and terminating at said nozzle at the top and having spaced side walls which terminate at their lower ends at said base, the inner one of said conduits engaging a gasket on said base surrounding said cup-shaped receptacle.

12. The steam vaporizer of claim 11 including air circulation means mounted within said base, said base including a top wall supporting said cover and said reservoir, an air conduit extending from said air circulation means into said steam generating chamber including an opening in said top wall between said inner and outer conduits,.an air director overlying said opening in said top wall and being between said inner and outer conduits to direct air horizontally across said cup-shaped receptacle, said inner conduit being formed with an opening opposite said director to permit circulated air to enter said inner conduit.

13. A steam vaporizer comprising a support base, a water reservoir removably received on said base, valve means on said reservoir activated by means on said base, steam generating chamber including a cup-shaped receptacle in said base having an electric heating element to convert water in said receptacle into steam, water conduit means extending form said valve means to said receptacle to supply water from said reservoir to said receptacle, said chamber having a removable cover overlying said cup-shaped receptacle, said cover having a nozzle which is movable to direct steam generated in said chamber in selected directions; wherein said support base includes a top wall supporting said water reservoir and said removable cover and said steam generating chamber, a medicant cup supported by said top wall above said cup-shaped receptacle, said cup having a central cup portion and an annular support ring connected together by radially extending spaced legs which permit steam generated in said receptacle to pass upwardly between said legs.

14. A steam vaporizer comprising a base housing supporting a water reservoir and a steam directing means, said water reservoir being detachable from said base housing for filling purposes, a steam generating chamber including a cup-shaped receptacle in said base housing having an electric heating element to convert water in said receptacle into steam, a water conduit to deliver water from said reservoir to said receptacle, said cup-shaped receptacle having a bottom wall, a drain conduit connected to an opening in said bottom wall to permit draining of residue, a manually operable pinch clamp mounted in said base housing, said drain conduit being a flexible tube which extends through said pinch clamp which is operable to either obstruct or permit free flow through said drain conduit, said drain conduit having a free end which extends to the exterior of said base housing.

15. The steam vaporizer of claim 21 wherein said base housing is formed with an elongated open recess into which said drain conduit extends, said recess having parallel walls which are spaced so that there will be interference between the drain conduit and said parallel walls allowing the end of the drain conduit to be stored in the open recess when not in use and manually withdrawn to drain residue, when desired.

16. A steam vaporizer comprising a base housing supporting a water reservoir and a steam directing means, said water reservoir being detachable from said base housing for filling purposes, a steam generating chamber including a cup-shaped receptacle in said base housing having an electric heating element to convert water in said receptacle into steam, a water conduit to deliver water from said reservoir to said receptacle, said cup-shaped receptacle including cylindrical side walls and a flat bottom wall with an annular portion of lesser diameter than the portion with the circular side walls being positioned adjacent the bottom wall to provide a stepped side wall, said electric heating element comprising a sheathed element in circular form being secured to the exterior of said receptacle in the stepped side wall portion in good heat transfer relationship with the contents of said receptacle, said water conduit being connected to said bottom wall, a drain conduit connected to said bottom wall of said receptacle to drain residue, said drain conduit extending outside of said base housing, and a thermostatic switch mounted on said receptacle and connected in circuit with said heating element to disable said element in the event of an overheat, condition.

17. The steam vaporizer of claim 16 wherein said base housing includes a top wall supporting said water reservoir and said steam directing means and said steam generating chamber, a medicant cup supported by said top wall above said cup-shaped receptacle, said cup having a central cup portion and an annular support ring connected together by radially extending spaced legs which permit steam generated in said receptacle to pass upwardly between said legs.

18. A steam vaporizer comprising a support base, a water reservoir removably received on said base, a steam generating chamber including a cup-shaped receptacle in said base having an electric heating element to convert water in said receptacle into steam, water conduit means extending from said reservoir to said receptacle to supply water from said reservoir to said receptacle, said chamber having a removable cover overlying said cup-shaped receptacle, said cover having a nozzle which is movable to direct steam generated in said chamber in selected directions, air circulation means mounted within said base, air inlet openings in said base to permit air to be drawn into said base by said air circulation means, an air conduit extending from said air circulation means into said steam generating chamber, air circulated to said steam generating chamber by said air circulation means being discharged through said nozzle and carrying with it entrained steam.

19. The steam vaporizer of claim 18 wherein said base includes a top wall supporting said cover and said reservoir, said air conduit including an opening in said top wall of said base adjacent to said cup-shaped receptacle and positioned under said cover, an air director overlying said air conduit opening and extending upwardly from said top wall to direct said circulated air across said cup-shaped receptacle.

20. The steam vaporizer of claim 19 wherein said cover comprises two nested conduit members secured together and terminating at said nozzle at the top and having spaced side walls which terminate at their lower ends at said base, the inner one of said conduits engaging a gasket on said base surrounding said cup-shaped receptacle.

21. The steam vaporizer of claim 20 wherein said air director is positioned between said inner and outer conduits to direct air horizontally across said cup-shaped receptacle, said inner conduit being formed with an opening opposite said director to permit circulated air to enter said inner conduit.

22. A steam removably vaporizer comprising as support base, a water reservoir received on said base, valve means on said reservoir activated by means on said base, a steam generating chamber including a cup-shaped receptacle in said base having an electric heating element to convert water in said receptacle into steam, water conduit means extending from said valve means to said receptacle to supply water from said reservoir to said receptacle, said chamber having a removable cover overlying said cup-shaped receptacle, said cover having a nozzle which is movable to direct steam generated in said chamber in selected directions; wherein said cup-shaped receptacle includes cylindrical side walls and a flat bottom wall with an annular portion of lesser diameter than the portion with the circular side walls being positioned adjacent the bottom wall to provide stepped side wall, said electric heating element comprising a sheathed element in circular form being secured to the exterior of said receptacle in the stepped side wall portion in good heat transfer relationship with the contents of said receptacle, said water conduit being connected to said bottom wall, and a thermostatic switch mounted on said receptacle and connected in circuit with said heating element to disable said element in the event of an overheat condition.

23. A steam vaporizer comprising a support base, a water reservoir removably received on said base, valve means on said reservoir activated by means on said base, a steam generating chamber including a cup-shaped receptacle in said base having an electric heating element to convert water in said receptacle into steam, water conduit means extending from said valve means to said receptacle to supply water from said reservoir to said receptacle, said chamber having a removable cover overlying said cup-shaped receptacle, said cover having a nozzle which is movable to direct steam generated in said chamber in selected directions; wherein said cup-shaped receptacle has a bottom wall, a rain conduit connected to an opening in said bottom wall to permit draining of residue from said receptacle having a free end which extends to the exterior of said base housing.

* * * * *

UNITED STATES PATENT AND TRADEMARK OFFICE

CERTIFICATE OF CORRECTION

PATENT NO. : 4,810,854

DATED : March 7, 1989

INVENTOR(S) : JURSICH ET AL

It is certified that error appears in the above-identified patent and that said Letters Patent is hereby corrected as shown below:

Column 8, Line 22 "Conduit" should be --conduit--.
Column 9, Line 29 "opening" should be --opening.--.
Column 10, Line 39 insert after "base," --a--.
Column 10, line 43 "form" should be --from--.
Column 11, Line 6 "21" should be --14--.
Column 11, Line 13 "residue," should be --residue--.
Column 12, Line 24 "removably" should be taken out.
Column 12, Line 25 add --removably-- before "received".
Column 12, line 39 insert --a-- before "stepped".
Column 12, Line 61 delete "rain" and insert --drain--.

Signed and Sealed this

Twentieth Day of February, 1990

*Attest:*

JEFFREY M. SAMUELS

*Attesting Officer* *Acting Commissioner of Patents and Trademarks*